United States Patent [19]

Anderson et al.

[11] Patent Number: 4,844,131

[45] Date of Patent: Jul. 4, 1989

[54] LOOM REED WITH REMOVABLE DENTS

[76] Inventors: Barbara C. Anderson, 334 Poplar St., Laguna Beach, Calif. 92651; Gerald P. Young, 31932 Paseo Terraza, San Juan Capistrano, Calif. 92675

[21] Appl. No.: 173,820

[22] Filed: Mar. 28, 1988

[51] Int. Cl.[4] ..... D03D 49/62

[52] U.S. Cl. ..... 139/192

[58] Field of Search ..... 139/188 R, 192

[56] References Cited

U.S. PATENT DOCUMENTS 954,512 4/1910 Gordeau .
1,112,741 10/1914 Wagner .
4,529,014 7/1985 Rast et al. .
4,694,867 9/1987 Gendelman et al. .

FOREIGN PATENT DOCUMENTS 49011 4/1889 Fed. Rep. of Germany ..... 139/192
3734 of 1888 United Kingdom ..... 139/192
618291 2/1949 United Kingdom ..... 139/192

*Primary Examiner*—Henry S. Jaudon
*Attorney, Agent, or Firm*—Plante Strauss Vanderburgh

[57] ABSTRACT

A reed with removable dents consisting of a reed frame and a plurality of spaced apart dents removably carried by transverse members of the reed frame. Spacing between dents is maintained by open ended tubular shaped spacers which are also removably carried by the transverse frame members. Headers are provided on the ends of the transverse members for clamping the dents and spacers in position. The spacers consist of open ended tubular bodies having a portion of the wall removed to create a longitudinal opening extending from end to end which is or can be dimensioned to permit the spacer to be coaxially removably mounted on a transverse member of the reed frame.

8 Claims, 1 Drawing Sheet

LOOM REED WITH REMOVABLE DENTS

FIELD OF THE INVENTION

This invention relates to reeds for looms and more particularly to reeds in which the dents are readily removed and added without disassembling the reed and where dent spacing is adjusted by the removal or addition of dents.

BACKGROUND OF THE INVENTION

A reed is a device used in connection with a loom for spacing warp yarns during the weaving process. Conventionally, a reed comprises a frame having generally wire members or dents extending between transverse members of a reed frame. The dents are arranged in spaced relationship which is referred to as the dent spacing. Conventionally, the dents are attached at their ends to the transverse frame members in a permanent or semipermanent manner and the dent spacing is fixed for a particular reed. Consequently, it is necessary to maintain an inventory of reeds of different dent spacings to accommodate the weaving of textiles of different tightness and the reed must be changed on the loom if it is desired to change the tightness of the textile being woven. In addition, should it become necessary to replace a dent due to wear and tear, the reed must be disassembled in order to remove the worn or broken dent and to replace it.

More recently, the taste in textile materials has changed and textiles having beads or other similar decorative articles woven into the fabric of the textile are in demand as well as textiles having different size warp in the same fabric. When weaving such a material it is necessary that the reed be provided with non uniform dent spacing. That is to say one or more large dent spaces are distributed on the reed to accommodate the large warp yarn or yarns carrying beads or other similar items to be woven into the textile fabric. In such a case it is advantageous to be able to conveniently change the dent spacings where required without having to utilize a different reed or to otherwise disturb the loom setup in order to weave such fabric. With reeds of conventional design, it is necessary to interrupt the weaving process to exchange the reed with one having large dent spacings adapted to receive larger warp yarns or, in the alternative, to utilize a reed having large dent spaces which can affect the tightness of the woven fabric in those areas where smaller warp yarns are being woven into the fabric.

Reeds designed for the replacement of worn or broken dents are known in the prior art. Such a reed design is shown in U.S. Pat. No. 954,512 issued Apr. 12, 1910 to J. G. Gourdeau. However, reeds of this design are inconvenient to use and require the complete disassembly of the reed to replace or remove dents middle of the reed or at the end portions of the reed.

SUMMARY OF THE INVENTION

The present invention relates to a reed in which dents can be removed or replaced conveniently and without the necessity of disassembling the reed. The reed of the invention comprises a reed frame including a plurality of dents which are in spaced relationship to define dent spaces. The ends of the dents are removably carried by transverse members of the reed frame. Spacers are disposed between the ends of the dents and the spacers are removably carried on the transverse members of the reed frame. Retainers are disposed on at least one end of each of the transverse members of the reed frame to exert a clamping action on the dents and spacers to retain them in the desired configuration. Releasing the retainer means releases the clamping action and the spacers and dents can be readily removed from the transverse members to adjust dent spacing and to remove or add dents.

In accordance with the invention, the spacers are open ended tubular members having a length equal to the dent spacing desired between adjacent dents. The ends of the spacers are open and a portion of the spacer wall extending longitudinally from end to end is removed to define an opening for coaxially mounting the spacer about the transverse member. Preferably the spacers are formed from a material sufficiently resilient to facilitate mounting the spacer on the transverse member.

To remove or add dents onto the reed frame, the retaining means are released so that the compressive force is released and the spacers and dents can be removed from any portion of the reed frame. If it is desired to increase dent spacing, spacers of greater length may be inserted in place of the dents that have been removed. By the same token, dent spacing can be decreased by adding additional dents and spacers of less length. The retaining means are then re-locked and the reed is ready for further use. This is readily accomplished without disassembling the loom or the reed and can be done without the necessity of cutting or otherwise changing the warp threads running through the reed. The reed as described herein is readily adjusted to any dent spacing desired or any combination of dent spacings desired and thus the reed is highly flexible and can be used for weaving fabric of different tightness. Using the reed of the present invention it is not necessary to maintain an inventory of reeds to weave fabrics of different tightness. In addition, maintenance and repair of the reed is substantially facilitated as broken or worn dents are easily replaced in a relatively short period of time as compared to conventional reeds which would require a shut down while the reed is removed, disassembled and repaired.

The invention will be more fully understood from the following detailed description taken in conjunction with the drawings.

DESCRIPTION OF THE INVENTION

Figure 1:
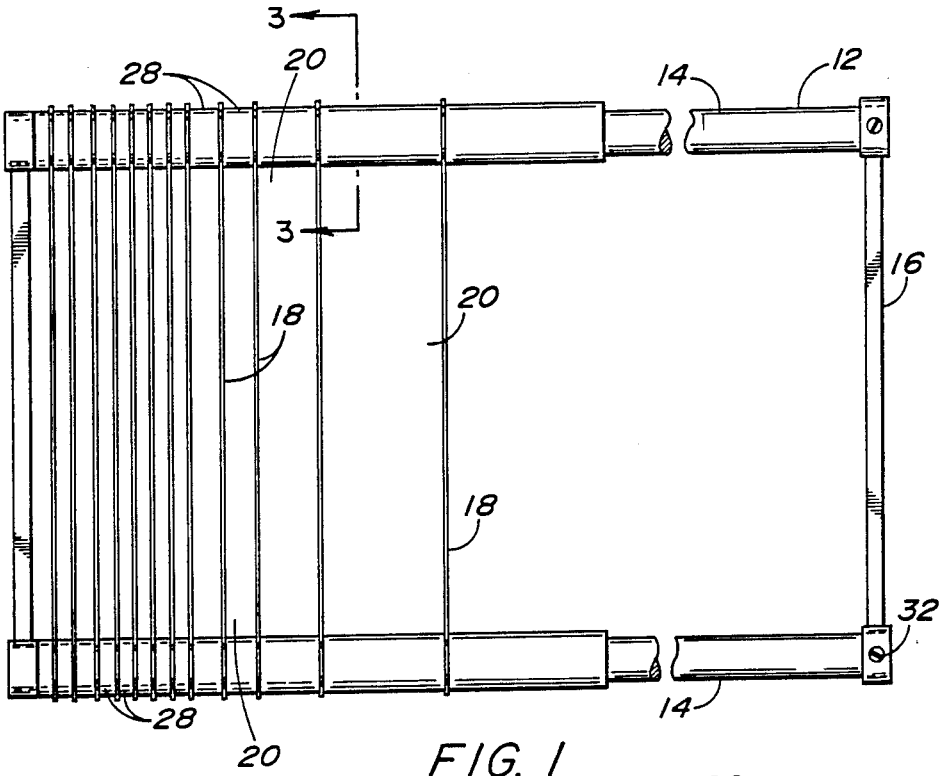
FIG. 1 is a front view, partially broken away for compactness of illustration, of a reed constructed in accordance with the present invention.
Figure 2:
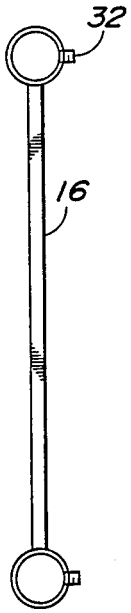
FIG. 2 is an end view of the reed of FIG. 1.

As illustrated in FIG. 1, the reed of the present invention comprises a reed frame 12 including upper and lower transverse members 14 and a header 16 at each end of the transverse member 14 to complete the frame assembly. The header 16 carries the ends of the upper and lower transverse members 14 and is provided with a locking screw for clamping the ends of the transverse members 14 and the other components of the reed as will be explained hereinafter. A plurality of dents 18 extend between the transverse members 14 in spaced relationship to adjacent dents 18. The dents 18 may be conventional wire or flattened wire bodies and may be of any of numerous and various dent designs known in the art. The spaces between the dents 18, referred to as dent spaces 20, define passages for warp yarns.

Figure 3:
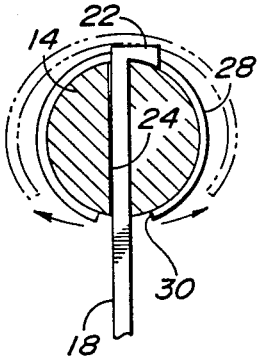
FIG. 3 is a sectional view in enlarged scale and partially broken away for compactness of illustration taken along line 3—3 of FIG. 1.

In accordance with the present invention, the ends of the dents 18 are adapted to be removably carried by the transverse members 14. As illustrated in FIG. 3, each transverse member 14 of the frame 12 is slit substantially along its entire length to define a longitudinal passage 24 opening at the top and bottom through of the transverse member 14 through which the ends of the dents 18 project. Each dent 18 is provided with an essentially normally extending projection 22 at its end to define a shoulder for carrying the end portion of the dent 18 over one edge of the longitudinal passage 24. The longitudinal passage 24 is of sufficient width to accept the edgewise thickness of the dent 18 which is mounted on the transverse member 14 by extending the end of the dent 18 up through the passage 24 and then turning the dent 18 so that the shoulder extends over the transverse edge defined by the longitudinal passage 24.

Figure 5:
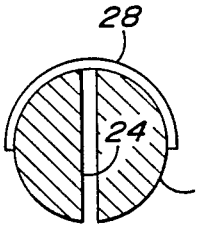
FIG. 5 is a sectional view similar to FIG. 3 but with the dent removed illustrating another embodiment of a spacer.
Figure 4:
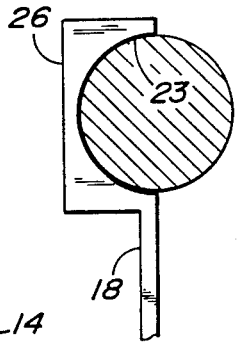
FIG. 4 is a sectional view, partially broken away for compactness of illustration, illustrating another method for mounting a dent on a transverse member of the reed frame.
Figure 6:
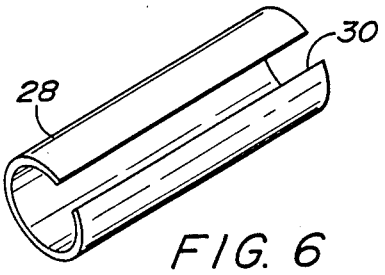
FIG. 6 is a perspective view of one embodiment of a spacer utilized in the invention.

Another embodiment is illustrated in FIG. 4 where each end portion 26 of the dent 18 is enlarged and provided with a recess 23 so that the enlarged end portion 26 of the dent 18 receives the transverse member 14 and the dent 18 is carried thereby. In the embodiment illustrated in FIG. 4 it is not necessary to slit the transverse member 14. The dent spaces 20 are maintained by spacers 28 which are removably mounted on the transverse member 14 between the dents 18. As shown in FIG. 3 and FIG. 6, the spacer 28 comprises a tubular body which is open at both ends and which has a portion of its wall removed to define a longitudinal opening 30 which extends from end to end of the body of the spacer 28 to permit the spacer 28 to be coaxially mounted on a transverse member 14. In the embodiment illustrated in FIG. 3 the spacer 28 is formed from a sufficiently resilient material to permit the wall of the body of the spacer 28 adjacent the longitudinal opening 30 to be spread apart sufficiently so that the opening 30 is wide enough to receive the transverse member 14 when mounting or removing the spacer 28. It is not critical, however, that the spacer 28 be formed of a resilient material and in the embodiment illustrated in FIG. 5 the spacer 28 comprises an arcuate body which defines a channel in which the transverse member 14 is received. In this embodiment, the spacer 28 is conveniently formed by cutting in half conventional styrene or polyvinyl tubing having a bore sufficiently large to receive the transverse member 14 of a reed frame 12 and the spacer overlies the transverse member 14.

The longitudinal dimension of the spacer 28 determines the size of the dent spaces 20 between adjacent dents 18 and this can be varied across the reed frame 12 as illustrated in FIG. 1 by the arrangement of spacers 28 of different lengths to accommodate larger warp yarn or warp yarn containing beads or other ornamental items.

The headers 16 receive the ends of the transverse member 14 and when locked down on the ends of the transverse member 14 by means of locking screws 32 in threaded passages in the headers 16, assert a clamping action which holds the dents 18 and spacers 28 in position on the transverse member 14. The dents 18 are readily removed or replaced and the spacers 28 exchanged to vary the dent spaces 20 without disassembling the entire reed frame 12. This is accomplished by backing out the locking screws 32 on one header 16 so as to release the clamping pressure on the dents 18 and spacers 28. The spacers 28 are readily removed and exchanged for spacers 28 of different longitudinal dimension if it is desired to change the dent spaces 20 between the dents 18. The dents 18 themselves, as mentioned, are also removable from the transverse member 14 so that one or more of the dents 18 can be removed from the reed frame 12 without the necessity of disassembling all or a part of the reed frame 12 to get to the dent 18 to be removed. When the desired changes in the dent spaces 20 and/or the dents 18 have been made, the header 16 is urged toward the opposite side of the reed frame 12 to assert clamping pressure on the dents 18 and spacers 28 and the locking screws 32 are turned down to retain the header 16 in place.

While the invention has been described in connection with certain preferred embodiments thereof, it will be understood by those skilled in the art that various arrangements other than those described in detail in the specification will occur to those persons skilled in the art, which arrangements lie within the spirit and scope of the invention. It is therefor to be understood that the invention is to be limited only by the claims appended hereto.

What is claimed is:

1. A reed for a loom comprising:

a. a reed frame including upper and lower transverse members;

b. a plurality of dents in spaced relationship to define dent spaces therebetween, the ends of said dents being removably carried by said transverse members of said reed frame;

c. spacer means removably carried by said upper and lower transverse members, said spacer means being disposed between the ends of said dents to maintain said dents in said spaced relationship;

d. each of said dents and said spacers being removable from said transverse members independently of adjacent dents and spacers; and e. retainer means on at least one end of each transverse members for exerting a clamping action on said dents and spacers carried by each said transverse member, said retainer means being releasable to terminate said clamping action whereby one or more of said dents can be removed and said spacer means can be exchanged to adjust the dent spaces of said reed while maintaining said reed in the assembled condition.

2. The reed o claim 1 wherein said each said spacer means comprises a tubular body having a through running bore and being open at each end, said tubular body having a portion of its wall removed to define a longitudinal opening which extends from end to end of the spacer for communication with its bore to receive a transverse member for coaxially mounting said spacer thereon, the length of said tubular body being substantially equivalent to the desired spaced relationship between adjacent dents.

3. The reed of claim 1 wherein each said spacer means comprises a body having a length substantially equivalent to a dent space between adjacent dents and an open channel extending the entire length of said body.

4. The reed of claim 1 wherein the dent spaces are uniform across the width of said reed.

5. The reed of claim 1 wherein dent spaces are varied across the width of said reed.

6. The reed of claim 1 wherein each of said transverse members is provided with a longitudinally extending slit opening to opposite surfaces thereof to define a longitudinal passage, the longitudinal dimension of said passage being at least equivalent to the length of the portion of said transverse member carrying said dents and said spacer means.

7. The reed of claim 6 wherein said dents are provided at each end thereof with an essentially normally extending projection to define a shoulder which is carried over one edge of said longitudinal passage.

8. The reed of claim 1 wherein said dents are provided with enlarged end portions, said end portions having laterally inwardly extending recesses for receiving said transverse member whereby said dent is removably carried at the ends thereof by said transverse member.

* * * * *